United States Patent [19]

Miyazawa

[11] 4,083,080

[45] Apr. 11, 1978

[54] DOOR CLOSER

[75] Inventor: Hiroshi Miyazawa, Hiratsuka, Japan

[73] Assignee: Tokico Ltd., Kawasaki, Japan

[21] Appl. No.: 744,799

[22] Filed: Nov. 24, 1976

[30] Foreign Application Priority Data

Nov. 26, 1975 Japan ..... 50-141413

[51] Int. Cl.[2] ..... E05F 3/00

[52] U.S. Cl. ..... 16/66; 16/44; 16/69

[58] Field of Search ..... 16/49, 137, 66, 69, 16/71, 79, 82, 84, 62, 64, 57, 58, 83; 49/362

[56] References Cited

U.S. PATENT DOCUMENTS

| | | | |
|---|---|---|---|
| 1,003,652 | 9/1911 | Regan | 16/49 |
| 3,042,957 | 7/1962 | Mussel et al. | 16/49 |
| 3,468,062 | 9/1969 | Custer | 49/362 |

*Primary Examiner*—Ronald Feldbaum

*Attorney, Agent, or Firm*—Wenderoth, Lind & Ponack

[57] ABSTRACT

A device for controlling the movement of a door has a pinion rotatably connected to the door, a rack meshingly engaging with the pinion and connected to a spring device for storing a force therein when the door is moved from its neutral position, and an engaging member resiliently engaging with the rack to restrain the movement of the door when the door is moved a predetermined amount from the neutral position.

5 Claims, 5 Drawing Figures

DOOR CLOSER

This invention relates to an improved door closer, or a device for controlling the movement of a door.

There already exists a door closer of the type in which the door closer acts as a conventional door closer within a desired range of angular movement of the door in the first stage thereof and acts to hold the door open within the remaining range of the angular movement thereof.

In the prior art door closer of the type including a pinion rotatable with the opening and closing movement of the door and a rack meshingly engaging during the pinion and associated with a spring device affording a door closing force, the rack and pinion are given a special construction to hold the door open at a desired position, and for this reason it is difficult to manufacture the rack and pinion.

This invention eliminates the aforementioned shortcomings of the prior art door closer by providing an engaging member in a door closer for engaging with a rack formed in an actuating plate associated with a gas spring or a metal spring storing a door closing force therein so as to control the movement of the rack thereby holding the door at a desired position.

The present invention may be better understood by reference to the attached drawings illustrating some embodiments of the present invention, in which.

Figure 1:
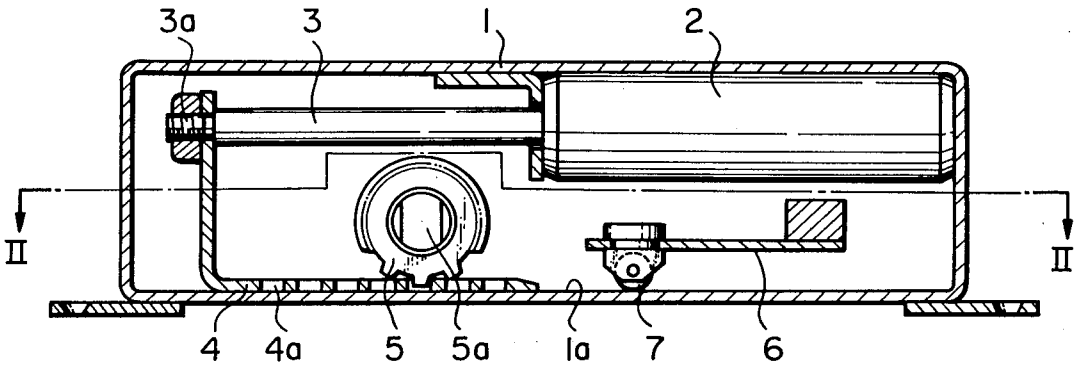
FIG. 1 is a longitudinal cross-sectional view of a door closer according to the present invention.
Figure 2:
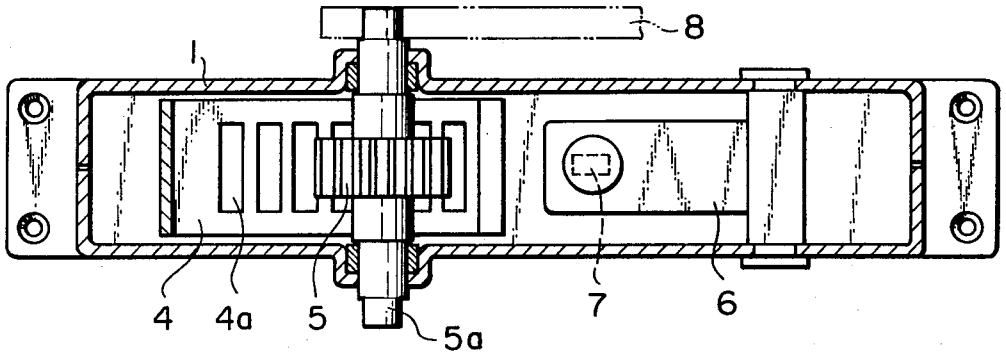
FIG. 2 is a cross-sectional view taken along line II—II in FIG. 1.

The door closer shown in FIGS. 1 and 2 comprises a main body 1 incorporating a gas spring 2 therein. A generally L-shaped actuating plate 4 is secured to the free end 3*a* of a rod 3 extending from the gas spring 2, and has a rack portion 4*a* extending along the inner wall of the main body 1. A pinion 5 secured on a shaft 5*a* is rotatably mounted on the main body 1 and connected to a door (not shown) by a lever 8. The pinion 5 meshingly engages with the rack portion 4*a* of the actuating plate 4. A roller 7 acting as an engaging member is supported by a leaf spring 6 and is adapted to engage with the rack portion 4*a* to control or prevent the rotation of the pinion 5 when the actuating plate 5 moves a predetermined amount in the rightward direction in FIG. 1.

When the door is opened within a predetermined range of angular movement of the door, which range is, for example, adapted to allow free passing of persons, the pinion 5 is rotated by the arm 8 and the shaft 5*a*; thus, the actuating plate 4 is moved in the rightward direction in FIG. 1 and the rod 3 of the gas spring 2 is displaced in the same direction. A force for closing the door is stored in the gas spring 2. When the door opening force is removed the rod 3 is moved leftward in the drawing by the force stored in the gas spring 2 at a reduced rate which is caused by a damping mechanism (not shown, but preferably incorporated in the gas spring), and thus the actuating plate 4 moves leftward in the drawing and the pinion 5 rotates to close the door through the arm 8.

Figure 3:
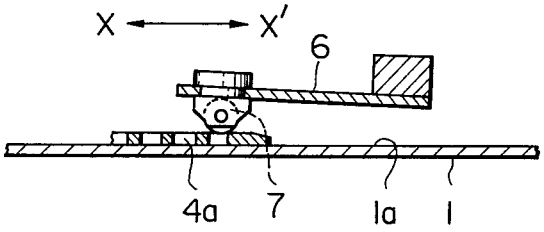
FIG. 3 is a partial cross-sectional view of the door closer of FIG. 1 wherein movement of parts is prevented.

When the door is opened beyond the aforesaid range, the actuating plate 4 moves further rightward in FIG. 1 and the roller 7 meshingly engages with the rack portion 4*a* of the plate 4 as shown in FIG. 3. When the door opening force is removed, the actuating plate 4 tends to move in the direction of arrow X in FIG. 3 due to the force stored in the gas spring 2. However, a component in the direction of arrow X′ of the force of the leaf spring 6 acting on the actuating plate 4 through the roller 7 being urged in the downward direction in the drawing, and a frictional force acting between the actuating plate 4 and the inner surface 1*a* of the main body 1 overcome the force of the gas spring acting in the direction of arrow X, whereby the movement of the plate 4 is prevented.

When the door is opened further from this position, the roller 7 will ride over the rack portion 4*a* a distance of one or more teeth of the rack portion 4*a* and hold the door at a position which differs from the aforementioned position by an amount determined by the pitch of the teeth of the rack portion 4*a*. The door can easily be closed by applying a force sufficient to overcome the restraining force of the roller 7 and the spring 6.

The opening of the door can be adjusted by adjusting the location of the roller 7 relative to the main body 1. The embodiment includes the gas spring 2, but the gas spring 2 may be replaced by a metal spring; moreover, a gas spring and metal spring may be used jointly.

Figure 4:
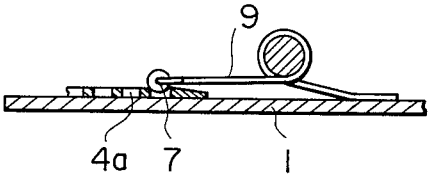
FIGS. 4 and 5 are views similar to FIG. 3 but showing modified forms of the present invention.
Figure 5:
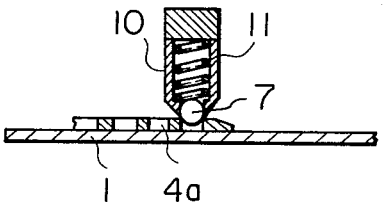

FIGS. 4 and 5 show modified forms of the present invention. In FIG. 4, the roller 7 is supported by a torsion spring 9 and, a roller or a ball 7 shown in FIG. 5 is supported in a guide 10 such that a portion of the roller or the ball 7 projects from the guide 10, with a coil spring 11 urging the roller or the ball 7 against the rack portion 4*a*.

In the embodiments the engaging member engaging with the rack portion of the actuating plate is shown in the form of a roller or a ball, but it will be noted that other forms such as a pawl or the like formed or attached on the spring 6 or 9 may be substituted for the roller or the ball shown in the embodiments.

As heretofore described, the door closer according to the present invention comprises an engaging member supported on a spring for meshingly engaging with the rack portion of an actuating plate connected to a spring means storing a door closing force therein; thus, the door can reliably retained at a desired position. Further, the present invention can easily be applied to door closer of the type having a pinion and rack mechanism for converting the door opening force and storing it in a spring device such as a metal spring or a gas spring to close the door.

What is claimed is:

1. A door closer comprising a housing, an actuating plate, means for storing a door closing force therein to which said actuating plate is connected for movement to store and release a door closing force, a rack portion formed on the actuating plate and slidable along the inner surface of said housing, a pinion meshed with said rack and rotatably driven by the opening and closing movement of a door, an engaging member for meshingly engaging with the rack portion of the actuating plate when the door is moved a predetermined amount thereby restraining the movement of the door, and mounting means on said housing on which said engaging member is mounted for resiliently urging said engaging member against the rack portion of the actuating plate.

2. A door closer according to claim 1 in which said mounting means is a leaf spring.

3. A door closer according to claim 1 in which said mounting means is a torsion spring.

4. A door closer according to claim 1 in which said mounting means is a guide having a spring therein, said engaging member being mounted in said guide for movement toward and away from said rack portion and being urged toward said rack portion by said spring.

5. A door closer according to claim 1 in which said means for storing a door closing force therein comprises a gas spring.

* * * * *